US009608374B2

(12) United States Patent
Beischer et al.

(10) Patent No.: US 9,608,374 B2
(45) Date of Patent: Mar. 28, 2017

(54) HOLDING FRAME FOR PLUG CONNECTOR MODULES

(71) Applicant: HARTING ELECTRIC GMBH & CO. KG, Espelkamp (DE)

(72) Inventors: Thomas Beischer, Espelkamp (DE); Hanno Wolff, Rahden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/892,983

(22) PCT Filed: Jun. 12, 2014

(86) PCT No.: PCT/DE2014/100194
§ 371 (c)(1),
(2) Date: Nov. 20, 2015

(87) PCT Pub. No.: WO2014/202050
PCT Pub. Date: Dec. 24, 2014

(65) Prior Publication Data

US 2016/0093980 A1 Mar. 31, 2016

(30) Foreign Application Priority Data

Jun. 17, 2013 (DE) ..... 10 2013 106 279

(51) Int. Cl.
*H01R 13/64* (2006.01)
*H01R 13/639* (2006.01)
(Continued)

(52) U.S. Cl.
CPC ..... *H01R 13/639* (2013.01); *H01R 13/514* (2013.01); *H01R 13/518* (2013.01);
(Continued)

(58) Field of Classification Search
CPC ..... H01R 13/28
(Continued)

(56) References Cited

U.S. PATENT DOCUMENTS 3,576,520 A 4/1971 Stauffer ..... 339/198
4,124,878 A * 11/1978 Ebner ..... H05K 7/1424 361/756
(Continued)

FOREIGN PATENT DOCUMENTS

DE 2736079 2/1979 ..... H01R 13/518
DE 19707120 6/1998 ..... H01R 13/514
(Continued)

OTHER PUBLICATIONS

German Office Action issued in application 10 2013 106 279.2, dated May 7, 2014 (5 pgs).
(Continued)

*Primary Examiner* — Phuong Dinh
(74) *Attorney, Agent, or Firm* — Hayes Soloway P.C.

(57) ABSTRACT

Described is a holding frame for receiving a multiplicity of plug-in connector modules. The plug-in connector modules are received in recesses of the holding frame by holding elements. The recesses of the holding frame are inserted into frame portions located opposite each other. The holding frame according to the invention allows a spring-loaded reception and support of the plug-in connector modules in the holding frame. Tolerances of the various plug-in connector modules and the contacting means thereof can be compensated. A secure and complete plugging in of plug-in connector modules of a modular plug-in connector together with the counter-plug-in connector thereof can be ensured in this way.

19 Claims, 4 Drawing Sheets

(51) Int. Cl.

| | |
|---|---|
| ***H01R 13/514*** | (2006.01) |
| ***H01R 13/518*** | (2006.01) |
| ***H01R 13/631*** | (2006.01) |
| *H01R 13/506* | (2006.01) |
| *H01R 27/02* | (2006.01) |

(52) U.S. Cl.
CPC ..... *H01R 13/6315* (2013.01); *H01R 13/506* (2013.01); *H01R 27/02* (2013.01)

(58) Field of Classification Search
USPC ..... 439/248, 247, 532, 701
See application file for complete search history.

(56) References Cited

U.S. PATENT DOCUMENTS

| | | | | |
|---|---|---|---|---|
| 5,186,645 | A * | 2/1993 | Bixler | H01R 13/639 439/358 |
| 6,004,162 | A | 12/1999 | Harting et al. | 439/701 |
| 6,196,869 | B1 | 3/2001 | Kay et al. | 439/532 |
| 6,773,271 | B2 | 8/2004 | Falchetti | 439/76.2 |
| 7,316,591 | B2 | 1/2008 | Ferderer | 439/701 |
| 2014/0179172 | A1 | 6/2014 | Riepe et al. | 439/701 |

FOREIGN PATENT DOCUMENTS

| | | | |
|---|---|---|---|
| DE | 202005020026 | 3/2006 | H01R 13/518 |
| DE | 60226208 | 5/2009 | H01H 85/20 |
| EP | 0756364 | 1/1997 | H02B 1/052 |
| WO | WO2011069522 | 6/2011 | H01R 13/518 |

OTHER PUBLICATIONS

International Preliminary Report on Patentability (no translation) issued in application PCT/DE2014/100194, dated May 11, 2015 (7 pgs).
International Search Report issued in application No. PCT/DE2014/100194, dated Sep. 15, 2014 (6 pgs).
International Preliminary Report on Patentability (English translation) issued in application PCT/DE2014/100194, dated Dec. 17, 2015 (6 pgs).

* cited by examiner

State of the art

HOLDING FRAME FOR PLUG CONNECTOR MODULES

BACKGROUND OF THE INVENTION

The invention relates to a holding frame for plug-in connector modules.

Such holding frames are needed to ensure that a plug-in connector of a modular design can be provided. A plurality of different plug-in connector modules can be combined as desired and inserted into such a frame. The holding frame holds the plug-in connector modules together and fixes them to each other. Subsequently, the holding frame can be inserted into a plug-in connector housing and fixed thereto. The plug-in connector can be connected to a corresponding mating plug-in connector that is also modular. Alternatively, the holding frame can be inserted and fixed to a housing or device wall as a so-called mounting frame.

This type of modular plug-in connectors can be used to combine and compile a multiplicity of individual plug-in connectors. All that is needed are various standardised plug-in connector modules as well as a holding frame as described in the present invention.

PRIOR ART

From EP 0 756 364 A1, a U-shaped support rail is known that is provided for a snap-on fastening of plug-in connector modules. The plug-in connector modules are held in the support rail on either side by means of holding means. A spring element provided is used for fixing the plug-in connector module to the holding means.

From U.S. Pat. No. 6,196,869 B1, a fastening rail for plug-in modules is known, wherein the plug-in modules are latched, by means of latching arms, into recesses in the fastening rail. The plug-in modules further have laterally attached spring elements which centre the plug-in modules in the fastening rail.

DE19707120C1 shows a holding frame for mounting plug-in connector modules. The plug-in connector modules are inserted into the holding frame and holding means on the plug-in connector modules interact with recesses provided on opposite frame portions of the holding frame and hold the plug-in connector modules in the holding frame in a form-locking manner.

In the case of this and other solutions known from the prior art, expediently, a great variety of different plug-in connector modules can be inserted into such a holding frame. The various plug-in connector modules have the most varied electric and/or pneumatic and/or optical and/or hydraulic contact elements in various dimensions, which are received in the modules.

A disadvantage of the solutions known from the prior art is the multiplicity of different plug-in connector modules each having different tolerances. It is above all in the plug-in regions of the contact elements (plug and socket contacts) that different tolerances and plug-in depths are necessary and specified by design.

As a result of these design-related tolerance differences of various plug-in connector modules, mismatches of two associated plug-in connector modules may occur in a holding frame depending on the combination of the plug-in connector modules. The consequence may be both incompletely contacted plug-in connector modules and plug-in connector modules which are "over-plugged" and contacted with an excessive force.

In both cases, this has a negative effect on the contacting and/or on the various components of the plug-in connector. Error-free contacting can no longer be ensured as a result of a "loose contact" or as a result of a mechanical failure of individual components as a result of an excessive force.

OBJECT OF THE INVENTION

It is the object of the invention to design a modular plug-in connector in such a way that differences in tolerances of different plug-in connector modules are compensated. A complete and secure contacting of all the plug-in connector modules present in a modular plug-in connector is to be ensured.

SUMMARY OF THE INVENTION

The invention relates to a holding frame that is designed to be substantially rectangular. The holding frame has recesses on opposite frame portions. These recesses are provided for receiving holding means located on plug-in connector modules. As a result of the reception of a plurality of plug-in connector modules in the holding frame, a so-called modular plug-in connector is formed.

According to the invention, spring elements are provided on the holding frame, which act upon plug-in connector modules inserted into the holding frame. In doing so, the spring elements expediently generate a force acting in the plug-in direction on the plug-in connector modules. As a result of the holding means of the plug-in connector modules being supported in the recesses of the holding frame with some play, the plug-in connector modules may be moved against the spring force.

The spring force of the spring elements moves the inserted plug-in connector modules again and again into an end position in the plug-in direction. When connecting a modular plug-in connector with a corresponding modular mating plug-in connector, tolerances in the plug-in connector modules can in each case and individually be compensated in this way.

Provided not all plug-in connector module pairs arrive in their fully assembled end position at the same time, an over-plugging of the pairs is prevented on account of the fact that the modules are displaced in the holding frame against the force of the spring elements in the direction opposite to the plug-in direction.

As a result of the spring-loaded support of the plug-in connector modules in the holding frame it is ensured that all of the plug-in connector modules are completely contacted with their mating plug-in connector modules and different tolerances are compensated.

Advantageous embodiments of the invention are indicated in the dependent claims.

BRIEF DESCRIPTION OF THE DRAWINGS

Embodiment Example

Two embodiment examples of the invention will be explained in more detail with reference to the following drawings, wherein.

DETAILED DESCRIPTION OF THE INVENTION

Figure 1:
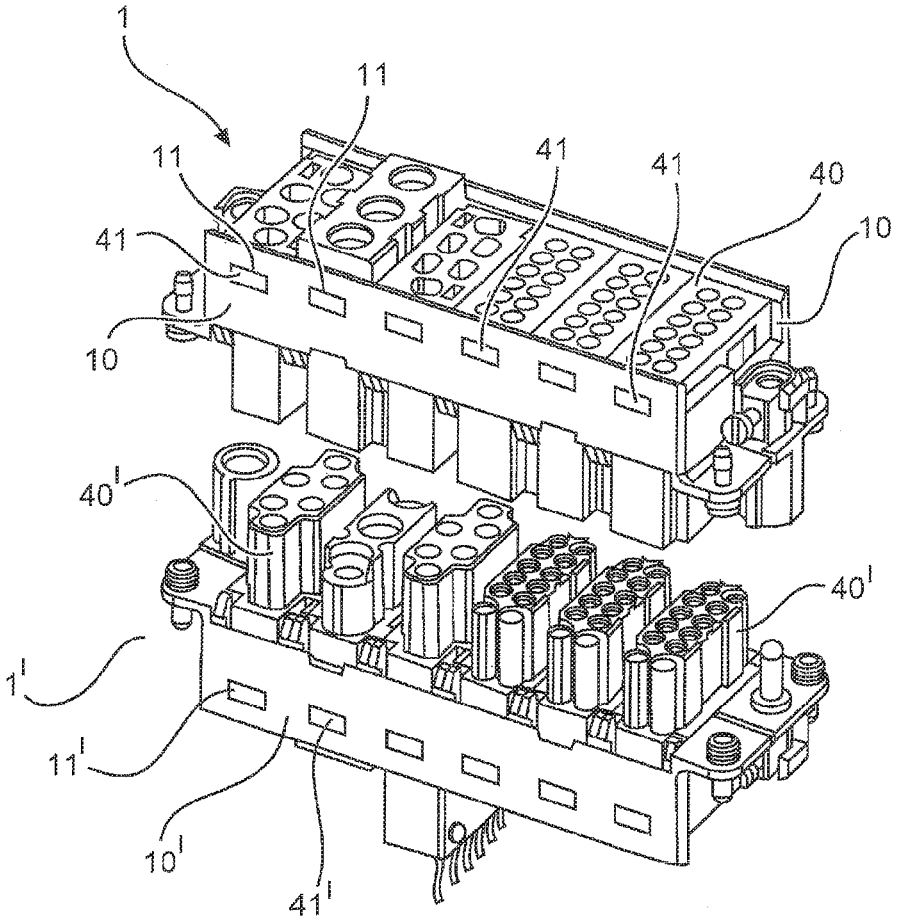
FIG. 1 shows a holding frame with plug-in connector modules according to the prior art.

FIG. 1 shows a holding frame 1 with six inserted plug-in connector modules 40 as well as a plug-in compatible holding frame 1' with likewise plug-in compatible plug-in connector modules 40' as known from the prior art. The illustrated holding frames 1 and 1' are of an identical design and are shown here only for the sake of completeness. Therefore, reference will only be made below to holding frame 1.

Holding frame 1 is shown here in an articulated implementation. This allows both of them to tilt the frame portions 10 forming the holding frame 1 along a hinge, in order to insert or to remove plug-in connector modules 40. The exact mechanics will not be discussed in any more detail because they are not part of the present invention. All that will be mentioned at this point is that a large number of multi-piece holding frames 1 are already known from the prior art.

In the case of holding frames 1 known from the prior art, recesses 11 are in each case provided in said frame portions 10. The recesses 11 are used for receiving, positioning and fixing the plug-in connector modules 40. To this end, the known plug-in connector modules 40 have holding means 41. The holding means 41 correspond in their shape to the recesses 11 of the frame portions 10.

As a result of the fact that the shapes of the recesses 11 and the holding means 41 correspond to each other, a secure seating of the plug-in connector modules 40 in the holding frame 1 is ensured. As a result, the plug-in connector modules 40 sit firmly and without play relative to each other.

Figure 2:
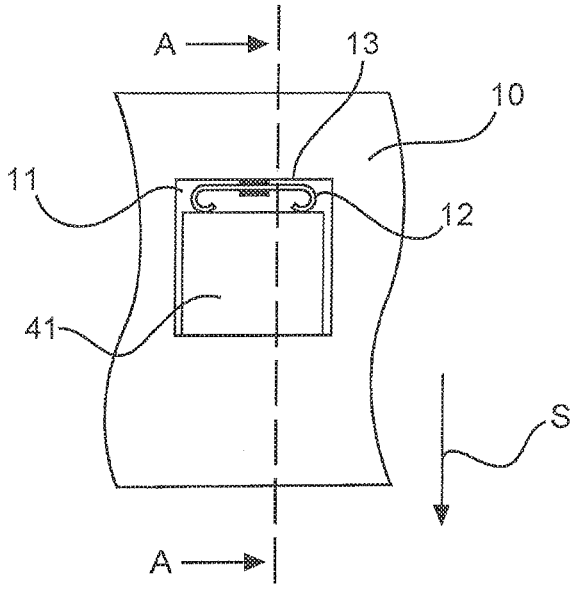
FIG. 2 shows a partial section of a first embodiment of a holding frame according to the invention.

FIG. 2 shows a partial cut-out of a first embodiment of a holding frame 1 according to the invention. What is shown is a partial cut-out of the frame portion 10 in a lateral view. In the frame portion 10, a recess 11 is shown as an example. In the recesses 11, as is also known from the prior art, holding means 41 of a plug-in connector module 40 are received.

However, contrary to the prior art as shown in FIG. 1, the recess 11 according to the invention is dimensioned to be larger opposite to the plug-in direction S than the holding means 41. Thus, the holding means 41 do not sit in the recess 11 in a play-free manner, as has been known so far. The enlarged recess 11 allows a linear movement of the holding means 41 in the recess 11 along the plug-in direction S.

Further, the holding frame 1 according to the invention has a spring element 12 that is received in the recess 11. This is preferably provided on the wall section 13 that is located opposite to the plug-in direction S.

The spring element 12 is disposed in such a way that it exerts a force on the holding means 41 that acts in the plug-in direction S. As a result of the effect of a force in the direction opposite to the plug-in direction S on the plug-in connector module 40, the latter can be displaced. Once the force is removed, the plug-in connector module 40 is displaced back by the spring element 12.

Figure 3:
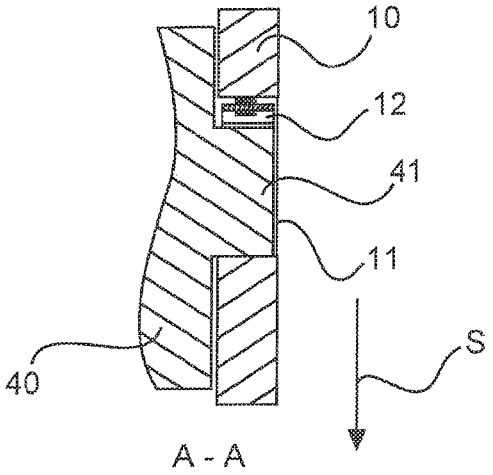
FIG. 3 shows a cross section of the holding frame of FIG. 2.

The partial cut-out of the holding frame 1 from FIG. 2 is shown again in FIG. 3 in a sectional view A-A. What can be seen is the plug-in connector module 40 (only indicated) with the holding means 41. The holding means 41 have been inserted into the recesses 11 of the frame portion 10. The spring element 12 is attached to the wall section 13 of the recesses 11 that is located opposite to the plug-in direction S.

The fixing of the spring element 12 to the wall section 13 can be realised for example by riveting, gluing, latching, screwing or welding.

From the wall section 13, the spring element 12 exerts a force on the holding means 41, which acts in the plug-in direction S. This force effects a forced movement of the holding means 41 and thus of the entire plug-in connector module 40 in the plug-in direction S.

Figure 4:
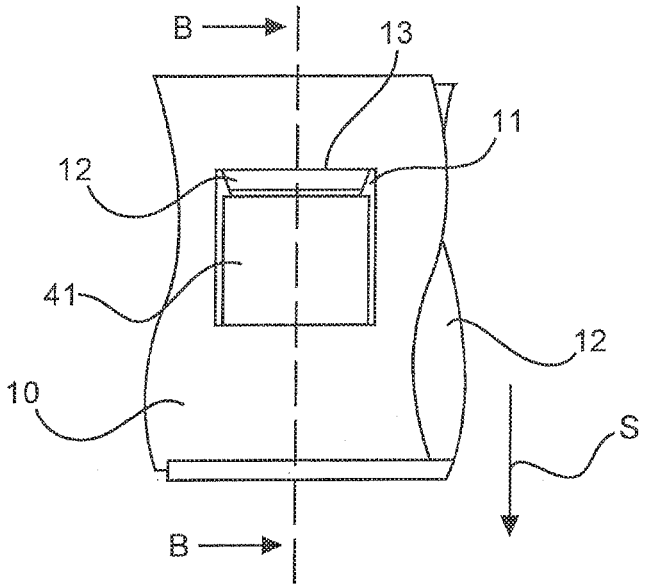
FIG. 4 shows a partial section of a second embodiment of a holding frame according to the invention.
Figure 5:
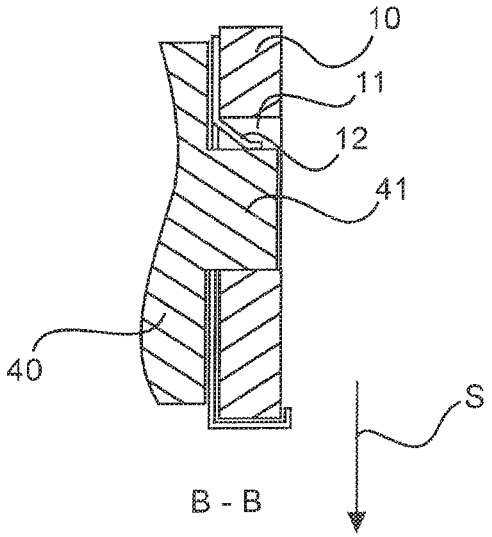
FIG. 5 shows a cross section of the holding frame of FIG. 4.

FIG. 4 and FIG. 5 show a second embodiment, corresponding to FIG. 2 and FIG. 3, of the holding frame 1 according to the invention. FIG. 4 is a partial cut-out of the frame portion 10 in correspondence with FIG. 2; FIG. 5 is a cross section of the partial cut-out from FIG. 4.

In this second embodiment, the spring element 12 is not provided in the recess 1 of the frame portion 10 but is formed by a planar base portion 12.1. This base portion 12.1 substantially corresponds to the shape of the frame portion 10 and is disposed on the inside thereof, facing the plug-in connector modules 40.

From the base portion 12.1, spring arms 12.0 extend into the recesses 11. These spring arms are provided for transmitting force onto the holding means 41. For transmitting the counter-force onto the frame portion 10, the base portion 12.1 moreover has an angled holding region 12.2. The holding region 12.2 encompasses the holding frame 10 in the plug-in direction S. Thus, a force acting in the plug-in direction S from the holding frame 10 can be transmitted onto the holding means 41.

In a particular embodiment it would also be possible to go without the holding region 12.2 and to fix the base portion 12.1 instead to the frame portion 10 using screws, rivets, by welding or by gluing.

Figure 6A:
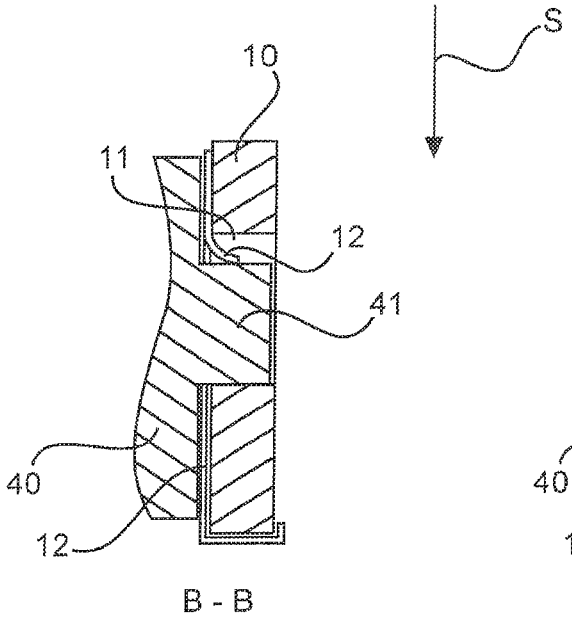
FIG. 6 shows cross sections of the holding frame of FIG. 4 in comparison.

FIG. 6, finally, shows the holding frame 1 from FIG. 5 in a comparison of two conditions. FIG. 6*a* corresponds to FIG. 5 in which the holding means 41 and thus also the plug-in connector module 40 are located in a position that is foremost in the plug-in direction S. As a result of the spring arm 12.0 of the spring element 12, the holding means 41 experiences a forced movement into this position.

Figure 6B:
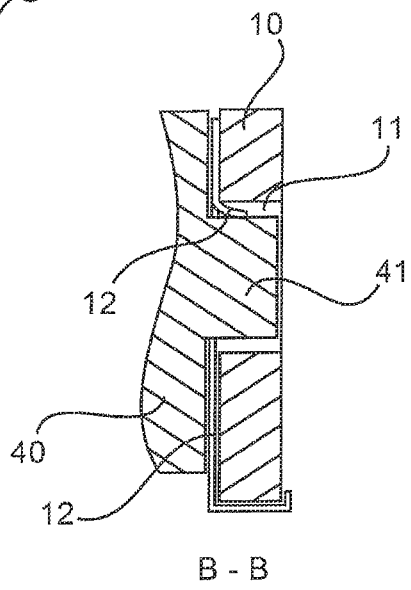

By comparison with this position, the holding means 41 and the plug-in connector module 40 in FIG. 6*b* are located in a position that is rearmost if viewed in the plug-in direction S. In the case of a force acting on the plug-in connector module 40 in the direction opposite the plug-in direction S. the spring element 12 according to the invention, here the spring arm 12.0 of the spring element 12, allows the plug-in connector module 40 to be displaced.

Thus, according to the invention, tolerances of plug-in connector modules 40 of different types can be compensated. A spring-loaded plugging in of plug-in connector modules 40 is possible, as a result of which a secure contacting of the contact elements can be ensured.

Holding Frame for Plug-In Connector Modules

LIST OF REFERENCE NUMERALS

1. Holding frame
10. Frame portion
11. Recess
12. Spring element
12.0 Spring arm
12.1 Base portion
12.2 Holding region

13. Wall section
40. Plug-in connector module
41. Holding means

The invention claimed is:

1. A holding frame for receiving plug-in connector modules, said holding frame comprising two frame portions located opposite each other with recesses provided therein, wherein holding elements of the plug-in connector modules to be received can be inserted into the recesses, wherein spring elements are provided on the holding frame, the spring elements acting upon plug-in connector modules received in the holding frame, and the spring elements exert a force that acts onto the received plug-in connector modules at least in the plug-in direction (S), wherein the spring elements act on the holding elements of the received plug-in connector modules.

2. The holding frame according to claim 1, wherein the recesses are dimensioned to be larger in the plug-in direction (S) than the holding elements to be received.

3. The holding frame according to claim 1, wherein the spring elements are detachably fixed to the holding frame.

4. The holding frame according to claim 1, wherein the spring elements are non-detachably fixed to the holding frame.

5. A holding frame for receiving plug-in connector modules, said holding frame comprising two frame portions located opposite each other with recesses provided therein, wherein holding elements of the plug-in connector modules to be received can be inserted into the recesses, wherein spring elements are provided on the holding frame, the spring elements acting upon plug-in connector modules received in the holding frame, and the spring elements exert a force that acts onto the received plug-in connector modules at least in the plug-in direction (S), wherein the spring elements are disposed in the recesses.

6. The holding frame according to claim 5, wherein the spring elements are provided on a wall section of the recesses, which is located opposite the plug-in direction (S).

7. A holding frame for receiving plug-in connector modules, said holding frame comprising two frame portions located opposite each other with recesses provided therein, wherein holding elements of the plug-in connector modules to be received can be inserted into the recesses, wherein spring elements are provided on the holding frame, the spring elements acting upon plug-in connector modules received in the holding frame, and the spring elements exert a force that acts onto the received plug-in connector modules at least in the plug-in direction (S), wherein the spring elements are provided outside of the recesses on the holding frame and protrude into the recesses.

8. The holding frame according to claim 7, wherein the spring elements are attached to the inside of the frame portions.

9. The holding frame according to claim 7, wherein the spring elements are attached to the outside of the frame portions.

10. The holding frame according to claim 7, wherein a multiplicity of spring elements are formed in one piece on each of the frame portions.

11. The holding frame according to claim 10, wherein the spring elements formed in one piece can be latched onto the frame portions.

12. The holding frame according to claim 10, wherein the one-piece spring element is made up of a base portion that is designed to be planar and that substantially has the shape of the frame portion and rests against the frame portion either from the inside or the outside, and wherein the base portion has a multiplicity of spring arms that protrude into the recesses.

13. The holding frame according to claim 8, wherein a multiplicity of spring elements are formed in one piece on each of the frame portions.

14. The holding frame according to claim 13, wherein the spring elements formed in one piece can be latched onto the frame portions.

15. The holding frame according to claim 13, wherein the one-piece spring element is made up of a base portion that is designed to be planar and that substantially has the shape of the frame portion and rests against the frame portion either from the inside or the outside, and wherein the base portion has a multiplicity of spring arms that protrude into the recesses.

16. The holding frame according to claim 9, wherein a multiplicity of spring elements are formed in one piece on each of the frame portions.

17. The holding frame according to claim 16, wherein the spring elements formed in one piece can be latched onto the frame portions.

18. The holding frame according to claim 16, wherein the one-piece spring element is made up of a base portion that is designed to be planar and that substantially has the shape of the frame portion and rests against the frame portion either from the inside or the outside, and wherein the base portion has a multiplicity of spring arms that protrude into the recesses.

19. The holding frame according to claim 12, wherein the base portion has an angled or rounded holding region.

* * * * *